US009353750B2

(12) United States Patent
Halttunen

(10) Patent No.: US 9,353,750 B2
(45) Date of Patent: May 31, 2016

(54) METHOD AND EQUIPMENT FOR CONTROLLING OPERATING TEMPERATURE OF AIR COMPRESSOR

(75) Inventor: Tero Halttunen, Kangasala (FI)

(73) Assignee: GARDNER DENVER OY, Tampere (FI)

( * ) Notice: Subject to any disclaimer, the term of this patent is extended or adjusted under 35 U.S.C. 154(b) by 335 days.

(21) Appl. No.: 13/367,405

(22) Filed: Feb. 7, 2012

(65) Prior Publication Data

US 2012/0207621 A1 Aug. 16, 2012

(30) Foreign Application Priority Data

Feb. 8, 2011 (FI) ..... 20115120

(51) Int. Cl.

*F04C 29/04* (2006.01)
*F04B 39/06* (2006.01)
*F04C 29/02* (2006.01)

(Continued)

(52) U.S. Cl.

CPC ..... *F04C 29/04* (2013.01); *F04B 39/0207* (2013.01); *F04B 39/06* (2013.01); *F04B 49/10* (2013.01); *F04C 29/021* (2013.01); *F04C 29/026* (2013.01); *F04B 2201/0402* (2013.01); *F04B 2201/0403* (2013.01);

(Continued)

(58) Field of Classification Search

CPC ..... F04C 29/04; F04C 29/026; F04C 29/021; F04B 49/10; F04B 39/06; F04B 39/0207; F01D 25/18; F01D 25/20; F01M 5/002; F02C 7/06; F16H 57/0412; F16H 57/0413; F16N 2210/02

USPC ..... 417/12, 228; 184/6.22, 104.1

See application file for complete search history.

(56) References Cited

U.S. PATENT DOCUMENTS 2,223,298 A * 11/1940 Smith ..... 236/92 B
4,431,390 A * 2/1984 Hart ..... 418/84

(Continued)

FOREIGN PATENT DOCUMENTS

EP 0007295 B1 11/1981
EP 1937977 A1 7/2008

(Continued)

OTHER PUBLICATIONS

Hannu Hammainen, Finnish Search Report and Office Action dated Nov. 16, 2011 for corresponding Finnish Application No. 20115120, p. 1-5.

(Continued)

*Primary Examiner* — Devon Kramer
*Assistant Examiner* — Lilya Pekarskaya
(74) *Attorney, Agent, or Firm* — Michael Best & Friedrich LLP

(57) ABSTRACT

Method and equipment to control operating temperature of an air compressor. A compressor element compresses air and oil and supplies it to an oil separator. In the separator, the air and oil are separated. Oil is led to a circulating pipe and returned to the compressor element. When necessary, at least some of the oil flowing in the oil circulating pipe is supplied to cooling, which is used for controlling operating temperature of the compressor such that it is as low as possible, but nevertheless so high that no condensation point is reached. The amount of oil to be supplied to cooling is controlled by a thermostatic valve based on a change in dimension of a controlling element such that dimensions of the controlling element are changed by an external command.

11 Claims, 2 Drawing Sheets

(51) Int. Cl.

| | |
|---|---|
| ***F04B 49/10*** | (2006.01) |
| ***F04B 39/02*** | (2006.01) |
| *F04C 18/16* | (2006.01) |

(52) U.S. Cl.

CPC ..... *F04B 2201/0801* (2013.01); *F04C 18/16* (2013.01); *F04C 2270/225* (2013.01); *F05C 2251/042* (2013.01)

(56) References Cited

U.S. PATENT DOCUMENTS

| | | | | |
|---|---|---|---|---|
| 4,475,876 | A * | 10/1984 | Olen | 418/84 |
| 5,318,151 | A * | 6/1994 | Hood et al. | 184/6.1 |
| 5,347,821 | A | 9/1994 | Oltman et al. | |
| 5,482,010 | A * | 1/1996 | Lemberger et al. | 123/41.1 |
| 7,114,913 | B2 * | 10/2006 | Coker | 415/47 |
| 7,204,678 | B2 * | 4/2007 | Truyens et al. | 417/228 |
| 7,762,789 | B2 * | 7/2010 | Scarpinato | 417/228 |
| 2003/0082065 | A1 | 5/2003 | Foerster | |
| 2004/0217180 | A1 | 11/2004 | Lu | |
| 2005/0089432 | A1 | 4/2005 | Truyens et al. | |
| 2005/0242311 | A1 * | 11/2005 | Willers et al. | 251/61 |
| 2009/0252632 | A1 * | 10/2009 | Daniels et al. | 418/84 |

FOREIGN PATENT DOCUMENTS

| | | | |
|---|---|---|---|
| EP | 2 058 522 | A2 | 5/2009 |
| FI | 65650 | | 2/1984 |
| GB | 2 111 662 | A | 7/1983 |
| JP | 2004-332727 | | 11/2004 |
| WO | WO9421921 | A1 | 9/1994 |
| WO | WO2007045052 | A1 | 4/2007 |

OTHER PUBLICATIONS

European Search Report for EP 2 058 522, published Jan. 12, 2011 (3pgs.).

Extended European Search Report regarding companion case EP 12153581.9, dated Sep. 10, 2014 (6pgs.).

* cited by examiner

METHOD AND EQUIPMENT FOR CONTROLLING OPERATING TEMPERATURE OF AIR COMPRESSOR

CROSS-REFERENCE TO RELATED APPLICATION

This application claims priority based on Finnish Application No. 20115120, filed Feb. 8, 2011, which is incorporated herein by reference in its entirety.

BACKGROUND

The invention relates to a method of controlling an operating temperature of an air compressor, the method comprising compressing by a compressor element a mixture of air and oil and supplying it to an oil separator, separating in the oil separator the air and the oil from one another, supplying oil to an oil circulating pipe for the purpose of returning it to the compressor element and supplying at least some of the oil flowing in the oil circulating pipe to cooling when necessary, and controlling the operating temperature of the compressor by the amount of oil to be supplied to cooling such that the operating temperature is as low as possible but nevertheless so high that no condensation point is reached.

The invention further relates to equipment for controlling an operating temperature of an air compressor, the equipment comprising a compressor element for compressing a mixture of air and oil, an oil separator for separating the air and the oil from one another, an oil cooler for cooling the separated oil when necessary and a thermostatic valve which, on the basis of the temperature of the separated oil, is configured to direct a necessary amount of the oil to flow to the oil cooler and to a bypass pipe so as to bypass the oil cooler as necessary.

In an air compressor, air and oil are fed to a compressor element. A mixture of air and oil compressed by the compressor element is supplied to an oil reservoir. In the oil reservoir, the air and the oil are separated from one another. Compressed air separated from the oil is forwarded via an aftercooler and a water separator for utilization. The oil is supplied via an oil circulating pipe to be returned to the compressor element. When necessary, at least some of the oil flowing in the oil circulating pipe is supplied to an oil cooler for cooling. The oil cooler may be bypassed by a bypass pipe. Typically, an air compressor is provided with a thermostatic valve which monitors the temperature of oil in the oil circulating pipe. When the temperature of the oil is lower than an operating value of the thermostatic valve, the thermostatic valve directs the oil to the bypass pipe so as to bypass the oil cooler. When, again, the temperature of the oil is sufficiently high, the thermostatic valve directs all oil via the oil cooler. A set value of the thermostatic valve has to be sufficiently high so that in all operating conditions the air contained in the oil reservoir does not reach the condensation point, since otherwise moisture condenses from the air in to the oil, which would impair the properties of the oil considerably and thus cause damage to the entire compressor system. This, in turn, means that the operating temperature has to be kept quite high, which again stresses the mechanical strength of the air compressor as well as also contributes to impairing the properties of the oil.

U.S. Pat. No. 4,431,390 discloses a solution wherein in addition to a thermostatic valve, a bypass valve is also provided for the purpose of bypassing the oil cooler. According to the publication, values influencing the condensation of water are measured and, on the basis thereof, the pneumatically operated bypass valve is controlled to open and close the bypass pipe. With such a solution, it is in practice impossible to continuously control the operating temperature of the oil compressor since the solution only comprises switching the cooler on and off. Further, it is impossible with this solution to react to rapid variations in the load of the compressor element, which may lead to great variations in the operating temperature and air pressure such that in connection with rapid variations temperature and condensation point peaks may occur.

EP 1 937 977 discloses a solution wherein the amount of oil being supplied to cooling and the bypass pipe is controlled by a mixing valve controlled by a control device. The control device is provided with a control algorithm having the outside temperature, air pressure and environmental relative humidity inputted thereto. The purpose of the control algorithm is to calculate the lowest possible operating temperature at which no water is condensed in to the oil, and the mixing valve is controlled in an attempt to restrain impairment of the oil and to avoid condensation of water in to the oil. However, such equipment has a complex, expensive and high-maintenance structure. The controlling element is quite large. The power demand of the controlling element is also relatively high. Furthermore, it is quite challenging to make the compressor unit operate in a reliable manner in connection with a failure of the control system.

SUMMARY

An object of the present invention is to provide a novel method and equipment for controlling the operating temperature of an air compressor.

The method according to the invention is characterized by controlling the amount of oil to be supplied to cooling by a thermostatic valve based on a change in dimension of a controlling member such that the dimension of the controlling member is changed by an external command as necessary.

Further, the equipment according to the invention is characterized in that the thermostatic valve is provided with a controlling member based on a change in dimension and the equipment includes a control unit whereto at least one piece of input data influencing determination of the magnitude of the condensation point of the air contained in the oil reservoir and the operating temperature of the oil reservoir are inputted as input data, whereby the control unit is configured to send a control command to the thermostatic valve to change the dimension of the controlling member as necessary.

In the disclosed solution, the mixture of air and oil is compressed by the compressor element and supplied to the oil separator. In the oil separator, the air and the oil are separated from one another. The oil is led to the oil circulating pipe so as to be returned to the compressor element. When necessary, at least some of the oil flowing in the oil circulating pipe is supplied to cooling. The amount of oil to be supplied to cooling is used for controlling the operating temperature of the compressor such that it is as low as possible, but nevertheless so high that no condensation point is reached. The amount of the oil to be supplied to cooling is controlled by a thermostatic valve based on a change in dimension of the controlling element such that the dimension of the controlling element is changed by an external command as necessary. Such a solution is simple and small and thus reliable and cost-wise inexpensive. The power demand of the controlling element is quite small and the element is very simple and easy to seal in connection with the system.

According to an embodiment, the thermostatic valve based on a change in dimension of the controlling member is a three-way valve which separates a necessary amount of the oil to flow to cooling and past it. An ordinary thermostatic valve is easily replaceable by such a thermostatic valve wherein the dimension of the controlling member is changed by an external command as necessary. Consequently, the ordinary thermostatic valves in existing compressors may easily be replaced by thermostatic valves controlled by external control, or new compressors to be manufactured may be made otherwise identical except for the thermostatic valve. An external command may be used for controlling the controlling member to change its dimension. In such a case, in the absence of an external command, the thermostatic valve operates as a conventional thermostatic valve, i.e. reacts only to the temperature of the oil flowing in the oil circulating pipe, operating, however, at a certain basic level, whereby the operation of the compressor unit is not disturbed but it temporarily operates only according to the operating temperature of the controlling member.

According to yet another embodiment, the change in dimension of the controlling member is based on the controlling member containing an expansion material which, as a consequence of thermal expansion, changes its dimension. In such a case, the dimension of the controlling member is changed by changing the temperature of the expansion material on the basis of an external command.

BRIEF DESCRIPTION OF THE DRAWINGS

The invention will be described in closer detail in the accompanying drawings, in which.

Figure 1:
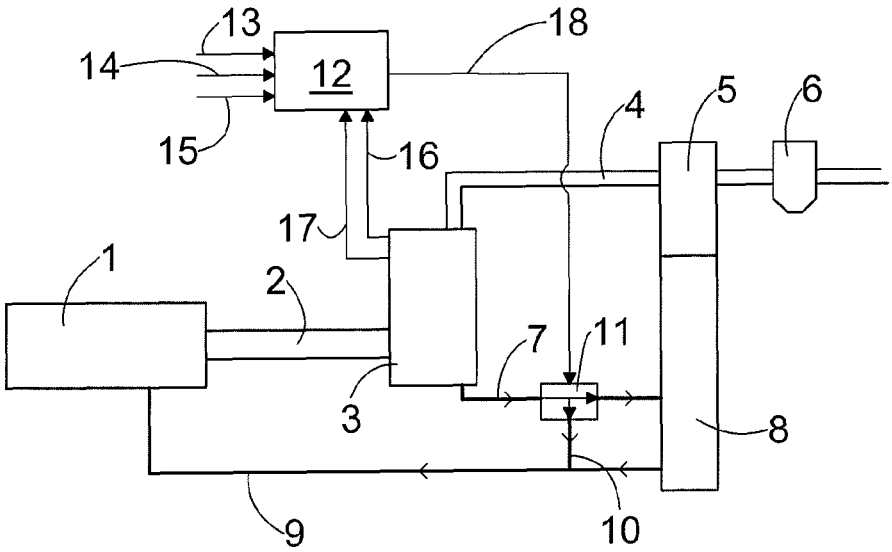
FIG. 1 is a diagram of an air compressor, and FIGS. 2*a*, 2*b*, and 2*c* schematically show a thermostatic valve in different operating situations.

For the sake of clarity, the figures show some embodiments of the invention in a simplified manner. The figures show exemplary diagrams of manners of implementation for a compressor and a valve. Naturally, the compressor and the valve may also be implemented otherwise. In the figures, like reference numerals identify like elements.

DETAILED DESCRIPTION

FIG. 1 shows an air compressor provided with a compressor element 1. The compressor element 1 may be a screw compressor or a piston compressor, for instance. Rotors of a screw compressor, for instance, are typically rotated by an electric motor. Typically, the electric motor is a short circuit motor which may be controlled e.g. by a frequency converter. For the sake of clarity, the figure shows no motor nor frequency converter, for instance. Instead of an electric motor, another motor drive, such as a combustion engine, may also be used.

The compression element 1 is supplied with air from an air inlet and oil from an oil inlet. A mixture of air and oil compressed by the compressor element 1 is supplied along a delivery pipe 2 to an oil reservoir 3.

In the oil reservoir 3, the oil and the air are separated from one another by an oil separator. The oil separator may be a cyclone separator provided in a lower part of the oil reservoir 3, for instance. Further, the oil reservoir 3 may also be provided with other oil separators wherefrom oil is returned e.g. directly to the compressor element 1. However, for the sake of clarity, the figure shows no oil separators or such direct return to the compressor element 1.

From the oil reservoir 3, compressed air cleaned of oil is supplied along an air pipe 4 to an air aftercooler 5. From the air aftercooler 5, the air is led via a water separator 6. In the water separator 6 moisture is removed, resulting in sufficiently dry compressed air.

A vast majority of the oil separated from the oil reservoir 3 is supplied along an oil circulating pipe 7 to an oil cooler 8. From the oil cooler 8 the oil returns to circulation to the compression element 1 along a return pipe 9.

In the circulation, the oil cooler 8 may be bypassed along a bypass pipe 10. In other words, if the oil is not to be cooled, it is by the thermostatic valve 11 directed from the oil circulating pipe 7 along the bypass pipe 10 to the return pipe 9.

The thermostatic valve 11 is a valve based on thermal expansion, i.e. it contains an expansion material which has a high thermal expansion factor within a certain temperature range. The expansion material may be e.g. wax. The thermal expansion of the expansion material is influenced by the temperature of the oil flowing in the oil circulating pipe 7. When the temperature of the oil is low, the thermostatic valve 11 directs at least most of the oil along the bypass pipe 10 to the return pipe 9. When, again, the temperature of the oil rises, the thermostatic valve 11 directs more and more oil via the oil cooler 8.

A basic set value of the thermostatic valve 11 has to be sufficiently high so that in all operating conditions the air contained in the oil reservoir 3 does not reach the condensation point, since otherwise moisture condenses from the air in to the oil, which would impair the properties of the oil considerably and thus cause damage to the entire compressor system.

The compressor system further includes a control unit 12. Data about environmental temperature 13, environmental moisture 14, and environmental air pressure 15 may be inputted as input data to the control unit. In addition, data about a delivery pressure 16 may be inputted to the control unit 12. On the basis of these data, the control unit 12 is able to determine the appropriate operating temperature 17, i.e. the temperature in the oil reservoir 3, in order for the air contained in the oil reservoir 3 not to reach the condensation point.

In principle, data e.g. about the environmental temperature 13 alone will suffice to calculate a target value for the operating temperature 17. By using several input data the control becomes more versatile and more accurate.

On the basis of the calculated target value of the operating temperature and the operating temperature 17 obtained as feedback, the control unit sends a control command 18 to the thermostatic valve 11. The thermostatic valve 11 is used for controlling the amount of oil to be circulated via the oil cooler 8, thus controlling the operating temperature 17.

The thermostatic valve 11 is provided with means for manipulating the temperature of the expansion material of the thermostatic valve 11. The thermostatic valve 11 may be provided e.g. with an electric resistor enabling the expansion material to be heated. In such a case, a control command 18 means that said electric resistor heats the expansion material. The thermostatic valve 11 then interprets that the temperature of the oil flowing in the oil circulating pipe 7 is higher than it is in reality, in which case the thermostatic valve 11 supplies more oil to the oil cooler 8 than without such a control command. Such a control command 18 may be given e.g. in a situation wherein measurement results show that outdoor air is very dry, in which case the operating temperature 17 may be quite low and yet no condensation point is reached. Thus, in a way, the thermostatic valve 11 is manipulated to operate in a desired manner.

Figure 2A:
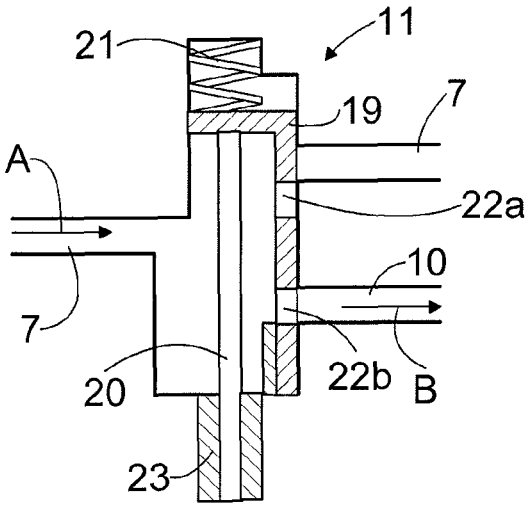
Figure 2B:
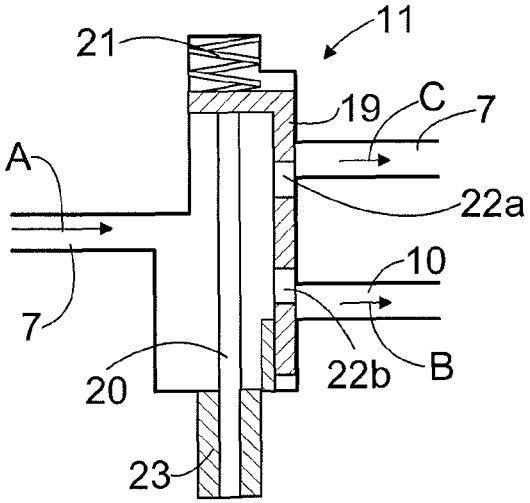
Figure 2C:
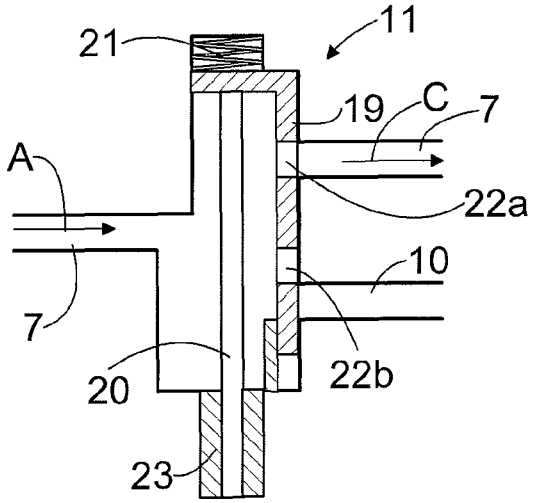

FIGS. 2*a*, 2*b*, and 2*c* show a thermostatic valve 11 in a very simplified and schematic manner. The thermostatic valve 11 is provided with a slide 19 whose position is determined by an expansion element 20. The thermostatic valve 11 is further provided with a spring 21 to ensure that the slide 19 returns to its other control position. The spring 21 is not necessary if the expansion element 20 and the slide 19 are reliably attached to one another and if the structure does not it otherwise require.

The slide 19 is provided with apertures 22*a* and 22*b* such that the position of the slide 19 determines how much of the oil coming from the oil reservoir 3 along the oil circulating pipe 7 further flows along the oil circulating pipe 7 to the oil cooler 8 and how much of the oil flows to the bypass pipe 10, thus bypassing the oil cooler 8.

In the embodiment of FIG. 2*a*, the oil coming from the oil reservoir 3 along the oil circulating pipe 7 as illustrated by arrow A is quite cold. In such a case, the expansion element 20 is in its shortest dimension and the aperture 22*b* resides at the bypass pipe 10 and, correspondingly, the aperture 22*a* resides at such a point that no oil is allowed to flow therethrough further to the oil circulating pipe 7 to the oil cooler 8. Thus, the thermostatic valve 11 directs the oil to flow in its entirety to the bypass pipe 10 as illustrated by arrow B.

FIG. 2*b* illustrates e.g. a situation wherein the oil flowing from the oil reservoir 3 along the oil circulating pipe 7 as illustrated by arrow A is slightly warmer than in the case illustrated in FIG. 2*a*. In such a case, this oil heats the expansion element 20 which, as a consequence of thermal expansion, changes its dimension, i.e. in the example of FIG. 2*b* becomes longer. The lengthening of the expansion element 20 moves the slide 19 such that the aperture 22*b* moves slightly in a sideways direction from the bypass pipe 10, in which case when compared with FIG. 2*a*, a smaller amount of oil flows to the bypass pipe 10 as illustrated by arrow B. Further, the movement of the slide 19 moves the aperture 22*a* such that it resides partly at the oil circulating pipe 7 leading to the oil cooler 8, in which case some of the oil flows as illustrated by arrow C to the oil cooler 8 for cooling.

FIG. 2*b* also illustrates a situation wherein the oil flowing along the oil circulating pipe 7 as illustrated by arrow A is as cold as in the case of FIG. 2*a* but the control unit 12 has, on the basis of input data, determined that the operating temperature may be reasonably low without the condensation point being reached. Thus, the control unit 12 has sent the thermostatic valve 11*a* control command 18 that the expansion element 20 be heated by an electric resistor 23. Consequently, heated by the electric resistor 23, the expansion element 20 changes its dimension, i.e. extends, such that the slide 19 directs some of the oil to the oil cooler 8 and some of it to the bypass pipe 10.

FIG. 2*c* illustrates e.g. a situation wherein the oil flowing from the oil reservoir 3 along the oil circulating pipe 7 as illustrated by arrow A is very hot. In such a case, the oil heats the expansion element 20 so much that, as a consequence of thermal expansion, it becomes so long that the slide 19 moves to a position shown in FIG. 2*c*. The aperture 22*a* of the slide 19 then resides at the oil circulating pipe 7 leading to the oil cooler 8 such that the oil flowing from the oil reservoir 3 along the oil circulating pipe 7 as illustrated by arrow A proceeds in its entirety along the oil circulating pipe 7 to the oil cooler 8 as shown by arrow C. Correspondingly, the aperture 22*b* resides at a side of the bypass pipe 10 such that the slide 19 completely prevents any flow to the bypass pipe 10.

On the other hand, FIG. 2*c* also illustrates e.g. an operating situation wherein the oil flowing from the oil reservoir 3 is as cold as in the case illustrated by FIG. 2*a*, but measurement results show e.g. that outdoor air is very dry. In such a case, the control unit may control the operating temperature to be low, i.e. also in this case the electric resistor 23 has been sent a control command 18 to heat the expansion element 20 by the electric resistor 23. Typically, the operating temperature of an air compressor lies within a range of 70 to 120° C.

The expansion material, or in other words the expansion element, may thus be heated by an electric resistor, for instance. The heating may also take place in some other way, such as by using an external medium, e.g. water, oil or air. Further, when desired, the expansion element may also be cooled by an external command. Similarly, the cooling may take place by using an external medium, e.g. water, oil or air. In addition to wax, the expansion material may be some other material having a high thermal expansion factor within a certain temperature range.

Instead of an expansion element containing an expansion material based on thermal expansion, e.g. a magnetostrictive or piezoelectric member may be used as a dimension-changing controlling member. In such a case, in order to change the dimension of the controlling member, e.g. a control device is used which receives measurement data about the temperature of the oil, and this control device gives e.g. the magnetostrictive or piezoelectric member a control command to change its dimension. The external control command 18 may then be inputted to this control device, in which case this external control command 18 is thus used for changing the dimension of the controlling member as necessary.

Further, the controlling member changing its dimension may include a part which is based on thermal expansion and which thus reacts directly to the temperature of the oil coming from the oil reservoir, and a part which changes its dimension by an external command and which may be e.g. a magnetostrictive part or a piezoelectric part.

When necessary, the thermostatic valve controllable by an external command is thus used for constricting the amount of oil flowing to the oil cooler from the oil circulating pipe 7. Simultaneously with constricting this flow, the flow to the bypass pipe 10 is at the same time opened. This enables the operating temperature to be controlled reliably, quickly and safely in all different operating situations. The operating situations may vary owing to variations in environmental conditions or loads, for instance. At its simplest, the control takes place by using the three-way thermostatic valve shown in FIG. 1. The operating temperature may also be controlled by a solution wherein e.g. a two-way valve constricting the oil flow and controllable by an external command is used for constricting the amount of oil flowing to the oil cooler 8. This means that a sufficient flow in the bypass pipe 10 has to be ensured in some other way, e.g. by a conventional three-way thermostatic valve. Thus, in the simplest and most cost-efficient manner, the control takes place by the solution according to FIG. 1 wherein only one valve is used in the oil circulation arrangement arranged from the oil reservoir 3 via the oil cooler 8 to the compressor element 1, the valve thus being said three-way thermostatic valve 11 controllable by an external command.

In some cases, the features disclosed in this application may be used as such, irrespective of other features. On the other hand, when necessary, the features disclosed in this application may be combined to provide different combinations.

The drawings and the related description are only intended to illustrate the idea of the invention. The details of the invention may vary within the scope of the claims.

What is claimed is:

1. A method of controlling an operating temperature of an air compressor, the method comprising:

compressing by a compressor element a mixture of air and oil and supplying it to an oil separator;

separating in the oil separator the air and the oil from one another;

supplying oil to an oil circulating pipe for the purpose of returning it to the compressor element and supplying at least some of the oil flowing in the oil circulating pipe to a cooling assembly when necessary;

controlling the operating temperature of the compressor by the amount of oil to be supplied to the cooling assembly;

processing data to minimize or eliminate condensation in a compressed air circuit of said air compressor, said data including information about the operating temperature;

providing an external command based, at least in part, on said processed data; and minimizing or eliminating condensation in the compressed air circuit, wherein said minimizing or eliminating includes changing a dimension of a control member to regulate the amount of oil to be supplied to the cooling assembly by a thermostatic valve with said external command as necessary, wherein the changing the dimension of the control member includes changing a temperature of an expansion material using the external command.

2. A method as defined by claim 1, wherein changing the dimension of the control member further includes using the external command to control an additional heating element to heat the expansion material.

3. A method as defined by claim 1, wherein the thermostatic valve is a three-way thermostatic valve.

4. A method as defined by claim 1 wherein said processed data further includes information which reads on an environmental condition.

5. A method of claim 4, wherein said environmental condition is the temperature of the environment.

6. A method as defined by claim 4 further comprising supplying oil to an oil reservoir in fluid connection with said oil separator after oil has been separated from air in the oil separator, wherein said control member changes dimension in response to the external control command and changes dimension in response directly to an oil temperature in said oil reservoir.

7. Equipment to control an operating temperature of an air compressor, the equipment comprising:

a compressor element for compressing a mixture of air and oil;

an oil separator in fluid connection with said compressor element;

an oil cooler in fluid connection with said oil separator and said compressor element;

a first flow path upstream of said oil cooler and downstream of said oil separator, said first flow path in fluid connection with said oil separator and said oil cooler;

a second flow path downstream of said oil separator and upstream of said compressor element, said second flow path in fluid connection with said oil separator and said compressor element and bypassing said oil cooler, said first and second flow path are fluidly connected;

a thermostatic valve provided with a control member comprising an expansion element and changeable in dimension, said dimension responsive to a control command, said thermostatic valve in fluid connection with said oil separator and said oil cooler, said control member configured such that a change in dimension of said control member results in a change in an amount of oil which will flow through said first flow path and said second flow path; and a control unit containing data processed to minimize or eliminate condensation in a compressed air circuit of said compressor, said data including information about said operating temperature, said control command based at least in part on said processed data and transmitted from said control unit.

8. Equipment defined by claim 7, wherein the equipment comprises means for changing a temperature of the expansion element.

9. Equipment as defined by claim 8, wherein the thermostatic valve comprises an electric resistor for heating the expansion element.

10. Equipment as defined by claim 7, wherein the thermostatic valve is a three-way thermostatic valve.

11. Equipment as defined by claim 7, wherein an oil reservoir is in fluid connection with said oil separator, said control command is an external control command generated by said control unit, and said control member changes dimension in response to the external control command and changes dimension in response directly to an oil temperature in the oil reservoir.

* * * * *